US005290672A

United States Patent [19]

Dunk

[11] Patent Number: 5,290,672

[45] Date of Patent: Mar. 1, 1994

[54] BASE PAPER FOR PHOTOGRAPHIC PRINTS

[75] Inventor: Paul Dunk, Slough, Berkshire, United Kingdom

[73] Assignee: The Wiggins Teape Group Limited, Basingstoke, Hampshire, United Kingdom

[21] Appl. No.: 921,440

[22] Filed: Jul. 31, 1992

Related U.S. Application Data

[63] Continuation of Ser. No. 796,885, Nov. 25, 1991, abandoned, which is a continuation of Ser. No. 248,263, Sep. 20, 1988, abandoned, which is a continuation of Ser. No. 147,084, Jan. 20, 1988, abandoned, which is a continuation of Ser. No. 800,780, Nov. 22, 1985, abandoned.

[30] Foreign Application Priority Data

Nov. 24, 1984 [GB] United Kingdom ..... 8429729

[51] Int. Cl.[5] ..... G03C 1/76

[52] U.S. Cl. ..... 430/538; 428/511; 430/536

[58] Field of Search ..... 430/538, 536; 428/511

[56] References Cited

U.S. PATENT DOCUMENTS 3,454,419 7/1969 Smith et al. .
3,560,227 2/1971 Eichhorn et al. .
3,615,552 10/1971 Danhauser et al. ..... 430/538
3,673,050 6/1972 Newman, Jr. et al. .
4,188,220 2/1980 Kasugai et al. ..... 430/538
4,211,825 7/1980 Shipman .
4,283,486 8/1981 Aono et al. ..... 430/538
4,343,858 8/1982 Thompson .
4,352,861 10/1982 Von Meer et al. ..... 430/538
4,389,455 6/1983 Asao et al. ..... 430/538

FOREIGN PATENT DOCUMENTS 862205 3/1961 United Kingdom .
1342662 1/1964 United Kingdom .
1519597 8/1978 United Kingdom .
1339045 11/1978 United Kingdom .
2061131 5/1981 United Kingdom .
2110116 7/1983 United Kingdom .

*Primary Examiner*—Jack P. Brammer
*Attorney, Agent, or Firm*—Burns, Doane, Swecker & Mathis

[57] ABSTRACT

Resin coated photographic base paper having improved stiffness is made by co-extruding a face side resin coating having a first layer of pigmented LDPE and over it a thin layer of a stiff polymer, especially polycarbonate. An intermediate layer of a strongly adhesive polymer may be included to enhance bonding between the first and second layers. The base paper may also have a co-extruded wire side resin coating with a stiff polymer second layer.

17 Claims, No Drawings

BASE PAPER FOR PHOTOGRAPHIC PRINTS

This application is a continuation of Ser. No. 07/796,885, filed Nov. 25, 1991, now abandoned which is a continuation of Ser. No. 07/248,263, filed Sep. 20, 1988, now abandoned, which is a continuation of Ser. No. 07/147,084, filed Jan. 20, 1988, now abandoned, which is a continuation of Ser. No. 06/800,780, filed Nov. 22, 1985, now abandoned.

This invention relates to base paper for photographic prints and in particular to resin coated photographic base paper.

The base paper used for photographic prints typically comprises a high quality paper substrate which has a coating on one or both sides. It acts to provide a suitable physical base structure for the image carrying layer(s), usually in one or more layers of gelatin based photographic emulsion. Originally such papers carried a surface coating of baryta (barium sulphate). In recent years such papers have been coated, usually on both sides with a layer of synthetic polymeric material, typically a polyolefin resin. The resin coating particularly provides protection to the paper from the relatively aggressive materials and conditions used in modern processing especially of colour prints. Such paper is commonly known as photographic base paper often abbreviated to "photobase", and the polymer coated type as "resin coated photographic base paper" often abbreviated to "resin coated photobase". The uncoated paper is commonly referred to as "raw photobase".

The side of a sheet of photobase which is to be coated with the photographic emulsion is commonly known as the "face side" and the other side as the "wire side" (because it is this side that is in contact with the Fourdrinier "wire" during papermaking). In resin coated photobase the coating of resin on the face side of the paper is known as the "face side resin coating" and that on the wire side of the paper the "wire side resin coating". The face side resin coating is typically pigmented to prevent (or at least reduce) the loss in photo-definition arising from internal reflection of incident light in developed prints made from it. The pigment used is usually a white pigment such as titanium dioxide.

An important property of photobase is its stiffness because the eventually produced photographic printing paper must not be too floppy. This is especially important where large prints are intended for hand processing, as for example in enlargements. A further reason for good stiffness is to reduce the tendency of sensitised print paper, which has gelatin based photographic emulsion layer(s) on it, to curl. In currently available resin coated photobase the major contribution to stiffness comes from the paper rather than the resin coating, because the typical resin, viz. low density polyethylene (LDPE), used for coating raw photobase has relatively low stiffness. It is not regarded as practical to use substantially stiffer polymers for the face and/or wire side resin coatings because the resins which have adequate stiffness and are photographically acceptable have serious disadvantages e.g. they are too expensive or are difficult to pigment adequately or do not adhere adequately to the paper raw base. The stiffness of LDPE can be increased by inclusion of high density polyethylene (HDPE) but, in the face side resin coating, the maximum amount used is relatively small because it is prone to give rise to 'gels'. Gels are small regions of resin which are harder than the resin in the surrounding area. As they tend to protrude from the surface of the resin, they give rise to faults in the layer of photographic emulsion coated on top of the resin. The gain in stiffness that can be achieved in practice by blending HDPE and LDPE in the face side resin is thus modest. Other stiff resins, such as polypropylene (PP) or polycarbonate (PC) cannot be satisfactorily blended with LDPE to form an homogeneous coating which adheres well to the base paper. The resin coating on the wire side of the photobase can contain a relatively high amount of HDPE because the presence of gels is less objectionable and, because the wire side resin does not need to be pigmented, there is less likelihood of forming gels in the absence or at low concentrations of a pigment like $TiO_2$. This can be used to make a stiffer wire side coating to compensate for curl caused by the coating of a gelatin based photographic emulsion on the photobase.

We have now surprisingly found that the provision of a thin layer of a relatively stiff polymer on top of the pigmented resin layer in the face side resin coating can give a substantial increase in the stiffness of the photobase.

The present invention accordingly provides resin coated photographic base paper comprising a substrate of paper carrying on its face side a composite coating comprising from 10 to 50 $g.m^{-2}$ of an extruded first coating layer of a low density polyethylene or a blend of low density and high density polyethylenes containing at least 50% by weight of low density polyethylene, the first coating layer containing at least 5% by weight of opacifying pigment and, overlying the first coating layer and firmly bonded thereto, from 0.1 to 18 $g.m^{-2}$ of an extruded second coating layer of a polymer having a stiffness modulus of at least 0.5 GPa.

We have found it particularly beneficial as is referred to in more detail below to employ a polycarbonate resin layer as the second layer in the base paper of the invention which, accordingly, includes resin coated photographic base paper comprising a substrate of paper carrying on its face side a composite coating comprising from 10 to 50 $g.m^{-2}$ of an extruded first coating layer of a low density polyethylene or a blend of low density and high density polyethylenes containing at least 50% by weight of low density polyethylene, the first coating layer containing at least 5% by weight of opacifying pigment and, overlying the first coating layer and firmly bonded thereto, from 0.1 to 18 $g.m^{-2}$ of an extruded second coating layer of a polycarbonate resin.

Although the provision of such an overlying second layer on the face side resin coating can give a significant improvement in stiffness even when the wire side of the paper substrate is not resin coated, the invention specifically includes the provision of a polyolefin resin coating on the wire side of the paper. Such a wire side resin coating improves the resistance of the photobase to the ingress of developer and fixer solutions and chemicals used in making photographic prints. The wire side resin coating may also comprise more than one layer and, in particular, it can include an outer layer of a stiff polymer. The invention accordingly includes resin coated photographic base paper comprising a substrate of paper carrying on its face side a composite coating comprising from 10 to 50 $g.m^{-2}$ of an extruded first coating layer of a low density polyethylene or a blend of low density and high density polyethylenes containing at least 50% by weight of low density polyethylene, the first coating layer containing at least 5% by weight of opacifyting pigment and, overlying the first coating layer and firmly bonded thereto, from 0.1 to 18 $g.m^{-2}$ of an extruded second coating layer of a polymer having a stiffness modulus of at least 0.5 GPa, in particular where the second coating layer is of a polycarbonate resin, and carrying on its wire side a coating of from 10 to 50 $g.m^{-2}$ of a polyolefin resin, optionally which wire side coating comprises from 10 to 50 $g.m^{-2}$ of a first coating layer of an extruded polyolefin resin and overlying the first coating layer and firmly bonded thereto, from 0.1 to 18 $g.m^{-2}$ of an extruded second coating layer of a polymer having a stiffness modulus of at least 0.5 GPa, in particular where the second coating layer is of a polycarbonate resin. It is understood that, as per the ASTM classification of polyethylenes, a low density polyethylene (LDPE) denotes a polyethylene having a density ranging from 0.910 to 0.940 $g/cm^3$ whereas a high density polyethylene (HDPE) denotes a polyethylene having a density greater or equal 0.941 $g/cm^3$.

The second layer of the face side coating is of a polymer having a stiffness modulus of at least 0.5 GPa although more usually this polymer will have a modulus of at least 1 GPa and polymers with even higher moduli e.g. more than 2 GPa are especially preferred. Broadly LDPE has a modulus of about 0.23 GPa, HDPE of about 1.2 GPa, PP of about 1.4 GPa and PC of about 2.5 GPa. Stiffness moduli as referred to herein are those measured according to American Standard Test Method (ASTM) D 790-80. Because of its high stiffness polycarbonate is an especially good material for the second layer, and the use of polycarbonate for the second layer constitutes a specific and important aspect of this invention. As well as stiffness, the polymer used in the second layer must be substantially colourless, capable of being extruded typically at temperatures up to 300° C., substantially inert to light and in particular resistant to discolouration on exposure to light, it must not interfere with photographic emulsion and it must be substantially inert to the materials used in developing and fixing a photographic image. Polymers which could be used as the second layer include HDPE, PP and PC, and especially PC, mentioned above, and linear low density polyethylene (LLDPE), polyamides such as Nylon 11, Nylon 6 and Nylon 66, and polyesters such as polyethylene terephthalate (PET) and polybutylene terephthalate (PBT). Polymers such as polystyrene and polyvinylchloride are generally not sufficiently heat and/or light stable to be suitable and the stabilizers commonly used currently are either not acceptable in photobase or reduce the stiffness of the polymer so much as to make it unsuitable.

The second layer of the stiff polymer may be of a single homopolymer, as described above, or it may be a co-polymer or a blend of polymeric materials having the required stiffness. Further, although reference is made to a single "second layer" of stiff polymer, it is possible that multiple layers of the same, or more usually differing composition can be employed. Examples of such multiple layers within the second layer could include a clear stiff outer layer and a pigmented stiff inner layer or a stiff outer layer with an inner layer of a blend of the outer layer polymer with the first layer polymer e.g. to give a PC/PC+LDPE/LDPE structure for the face side resin coating with the LDPE and possibly the blend layer containing pigment. One reason for including a layer (or layers) of a polymer blend is to enhance the effective adhesion between the "first" and "second" layers. This, and other methods of enhancing adhesion, are discussed further below.

The second layer, of still polymer, is thin in that it constitutes an amount of 0.1 to 18 $g.m^{-2}$, corresponding approximately, depending on the densities of the polymer used, to a thickness of 0.1 to 15 my.m (micrometres). The densities of some stiff polymers, referred to above, are HDPE 0.95, PP 0.9, PC 1.2 $g.cm^{-3}$. Broadly, the heavier (thicker) the second layer the greater the improvement in stiffness. However, the stiff polymers, notably polycarbonate, are generally more expensive than the polyethylene used conventionally and, thus, the use of second layers containing less than 15 $g.m^{-2}$ polymer is desirable to save cost. We have not noticed any increased benefit by using more than about 10 $g.m^{-2}$ and this represents a practical maximum for improving stiffness in most cases. In practice it is difficult to consistently provide a second layer of less than about 1 my.m, even using coextrusion, as described below, although we have made samples (by coextrusion) with second layers as thin as about 0.1 my.m thick and which show significant improvement in stiffness. A practical thickness range of the second layer would be 3 to 10 my.m and particularly 4 to 8 my.m. In translating thickness to amount in $g.m^{-2}$ allowance for the density of the second layer must be made especially for polycarbonate which has a higher density than the other stiff polymers specifically referred to above.

To maximise the benefit in increasing stiffness, it is important that the second layer of stiff polymer adheres well to the first layer. One possibility, that of using blends in an intermediate layer, has been referred to above. This can be done when the respective polymers can be blended to give an adequately homogenous and stable blend. Usually, the blend will have physical properties intermediate the individual components depending on the proportions. Another possibility is to provide an intermediate layer between the "first" and "second" coating layers of a polymer which strongly adheres to the first and second coating layers. Examples of suitable strongly adhesive polymers include ethylene-vinyl acetate copolymers (EVA), ethylene-acrylic acid copolymers (EAA), ethylene-methacrylic acid copolymers (EMA) and the ethylene-vinylacetate terpolymers, ethylene terpolymers and chemically modified polyolefin resins such as those sold under the trade designations CXA by DuPont, Modic by Mitsubishi and Plexar by Chemplex. The intermediate layer will typically be from 1 to 10 $g.m^{-2}$ and more commonly from 4 to 9 $g.m^{-2}$. Usually, such strongly adhesive polymers have relatively low stiffness, typically somewhat less than that of LDPE, and it is particularly surprising that the inclusion of an intermediate layer of such a polymer appears not to have a significant adverse effect on the overall stiffness of the photobase. The intermediate layer may be of the strongly adhesive polymer in a blend with, for example, polyethylene. Such blends can contain up to 75% of the other polymer given that the blend has appropriate properties. The use of such blends can be important especially where the intermediate layer is pigmented as pigments are usually used as masterbatches in e.g. low density polyethylene. The provision of a strongly adherent intermediate layer is considered to be a specific and important subsidiary feature of the invention. It is of particular value when the second layer is of polycarbonate resin.

The invention, accordingly, further includes resin coated photographic base paper comprising a substrate of paper carrying on its face side a composite coating comprising from 10 to 50 $g.m^{-2}$ of an extruded first coating layer of a low density polyethylene or a blend of low density and high density polyethylenes containing at least 50% by weight of low density polyethylene, the first coating layer containing at least 5% by weight of opacifying pigment, overlying the first coating layer, a second coating layer of from 0.1 to 18 $g.m^{-2}$ of a polycarbonate resin, and intermediate the said first and second coating layers, a layer of from 1 to 10 $g.m^{-2}$ of a polymer, which is strongly adhesive towards both the first and second layers, serving to firmly bond the said first and second layers where the photobase includes a wire side resin coating with a second coating layer of stiff polymer an intermediate layer of a strongly adhesive polymer can be included. When an intermediate layer of a strongly adhesive polymer is used it may, advantageously include a pigment, and in particular titanium dioxide, as described in more detail below.

A known problem in making resin coated photobase is in ensuring good adhesion between the resin coating and the raw paper base. Methods of overcoming this difficulty are known but the use of a coextrusion technique in this invention opens up the possibility of deliberately coextruding a polymer layer between the pigmented LDPE first coating layer and the raw base which serves to ensure good adhesion. The coatweights used will typically be similar to those for the "intermediate" layer referred to above and will usually be from 1 to 10 $g.m^{-2}$, more commonly from 43 to 9 $g.m^{-2}$. The polymers which can be used for this include those indicated above as being suitable for inclusion in a strongly adhesive layer between the 'first' and 'second' coating layer. The use of such an adhesive layer between the pigmented LDPE and the raw paper base constitutes a specific subsidiary feature of this invention. It is also possible to include such a layer of a strongly adhesive polymer between the wire side polyolefin resin coating and the raw paper base.

The invention, accordingly, further includes resin coated photographic base paper comprising a substrate of paper carrying on its face side a composite coating comprising from 10 to 50 $g.m^{-2}$ of an extruded first coating layer of a low density polyethylene or a blend of low density and high density polyethylenes containing at least 50% by weight of low density polyethylene, the first coating layer containing at least 5% by weight of opacifying pigment, overlying the first coating layer, a second coating layer of from 0.1 to 18 $g.m^{-2}$ of a polycarbonate resin, and intermediate the base paper and the said first coating layer, a layer of from 1 to 10 $g.m^{-2}$ of a polymer, which is strongly adhesive towards both the base paper and the first coating layer, serving to firmly bond the said base paper and the first coating layer.

The effect of providing a thin second layer of a stiff polymer overlying a pigmented first layer in the face side resin coating is to increase the stiffness of the photobase. The increase in stiffness which might be expected from consideration of photobase according to this invention as a compound beam is difficult to assess precisely because it depends on assumptions on the behaviour of the various parts of the photobase and the interactions at the interfaces between polymer and polymer and polymer and paper. Nevertheless, from baseline properties the increase observed is generally greater than would be expected. We cannot fully account for this but we think it is possible that the second layer, being thin, experiences a degree of orientation during extrusion and/or cooling which causes the second layer to have a higher stiffness than the polymer itself (published stiffness data being for test 'plaques' typically several mm thick) or that the photobase is made stiffer by the composite structure.

However, these suggestions are not a complete explanation of the observed properties of photobase according to this invention. In particular, we cannot explain fully the behaviour of photobase where the second coating layer is of polycarbonate particularly at a coatweight of from 3 to 18 especially 4 to 10 $g.m^{-2}$. Briefly we have found that the stiffness in the machine direction (MD) is increased but the stiffness in the cross-machine direction (CD) is increased to a proportionally greater extent. Further, the measured CD stiffness depends on the direction of bending. Thus when the polycarbonate is in tension the measured stiffness is significantly greater than when the polycarbonate is in compression. The stiffness in the MD does not show any significant difference in this way. The effect of this phenomena is that photographic base paper according to the invention is more "square" and usually less liable to curl. These observations are very difficult to account for. The enhancement of overall stiffness can be even more marked when a composite multilayer wire side coating with a polycarbonate second layer is used as the enhancement of CD stiffness for each polycarbonate coating will complement each other and, thus reduce or eliminate the anisotropy in CD stiffness.

The second layer can be unpigmented or pigmented with conventional opacifying pigment. However, the stiff polymers used in the second layer can be relatively difficult to coextrusion coat onto paper if they contain large amounts of pigment, e.g. greater than about 5%. Subject to this the amount of opacifying pigment can be similar to that used in the first layer. If used the opacifying pigment will normally be a white pigment typically titanium dioxide. There can be a benefit in using low pigment loadings in the second layer in that it can enable the use of higher pigment loadings in the first layer. This is discussed in more detail below.

In this invention the first layer is of LDPE or a blend of at least 50%, and more usually at least 70%, of LDPE with HDPE and contains opacifying pigment. The opacifying pigment is usually white, in which case it is almost invariably titanium dioxide and usually rutile, although it can be black e.g. carbon black as is used in making photobase for so-called "instant" prints. The overall amount of pigment is such as to give the desired degree of opacity and, as indicated above, the amount used is at least 5%. When rutile titanium dioxide is used the amount is typically at least 8% and commonly 12 to 15% by weight of the layer. In the present invention, as is noted briefly above, we have found that, using coextrusion coating, see below, significantly higher pigment loadings are possible in the first layer when the second layer is not heavily pigmented. An entirely unpredictable benefit arising from this possibility of increasing the concentration of pigment in the first layer is that it is practical to use anatase titanium dioxide as the opacifying pigment in high enough concentrations to make it attractive to use in photobase. Anatase has advantages over rutile when used as an opacifying pigment in resin coated photobase as it has a bluer tint than rutile (blue pigment e.g. ultramarine, is often included with rutile in the face side resin to make it more blue) and gives a brighter product. However, it is very difficult to use especially at concentrations which make it a good opacifying pigment and its inclusion is often deliberately avoided despite its advantages. The method of this invention enables the use of satisfactorily high concentrations of anatase to achieve good opacity and tint without the severe production problems usually encountered. When such higher pigment loadings are used the concentration of pigment can be up to 25% and possibly higher e.g. up to 35%.

As is noted above when a strongly adhesive intermediate layer is used it can be pigmented and the amount of pigment used will typically be similar to those used in the LDPE (first) layer.

the range of pigment content referred to above (typically 12 to 15%) are typical of conventional resin coated photobase which has a face side resin coating thickness of from 20 to 40 my.m. Because the method of present invention enables the use of higher concentration of pigment it is possible to use somewhat thinner pigmented layers than previously considered appropriate whilst maintaining opacity.

Other conventional additives can be included in the first layer. Examples include long term stabilizers such as the phosphonites described in UK Specification 2048278 and the polymeric hindered amine Chimassorb 944 used as described in European Patent Specification No. 0085523, optical brighteners and blue pigments such as ultramarine pigment which are included to enhance the visual brightness of the photobase.

The wire side polyolefin resin coating according to the invention can be of a conventional type for photobase. Typically it will be of LDPE or a blend of LDPE and HDPE which may include more than 50% e.g. up to 75% HDPE. The amount of the wire side coating will typically be from 5 to 50 and more commonly from 15 to 35 g.m.$^{-2}$. Whilst it is possible to include pigment in the wire side resin coating, it is not necessary or particularly advantageous to do so. When an overlying layer of stiff polymer and, optionally, an intermediate layer of strongly adhesive polymer are used the thickness of these layers will typically be similar to those for the face side resin coating.

The surface finish on both wire and face side resin coatings can be gloss, silk, stipple or other finish as desired. The maximum degree of gloss on the face side resin coating which can be obtained in the product and by the method of the present invention is higher than with equivalent currently commercially available materials. The improvement in the maximum degree of gloss is particularly noticeable when the second layer is polycarbonate. Moreover, this improvement can be maintained at higher line speeds than are practical for producing gloss surfaces on LDPE coatings. This is an important practical advantage. The outer surface of the wire side resin can be further treated with a conventional coating to aid writability.

A further and entirely unexpected advantage in using a stiff polymer, specifically polycarbonate, second layer in the face side resin coating is that the incidence of pitting is reduced as compared with that obtained with a pigmented LDPE monolayer. We do not understand why this result is obtained but it is important, particularly as it can be achieved with low coatweights of the second layer.

The advantages by the use of a second layer of stiff polymer and especially where the stiff polymer is polycarbonate, are such that it may be commercially advantageous to use a relatively thin second layer of the stiff polymer. This could result in obtaining a lesser improvement in stiffness whilst taking advantage of the other improvements. A reason for adopting this type of compromise is the relatively high cost of stiff polymers e.g. currently polycarbonatec costs about four times that of LDPE.

The photographic base paper of this invention is made by extrusion coating multiple layers of various polymeric resins onto paper. At least some of the layers are sufficiently thin that, using current technology, it would be impractical and might not be possible to undertake commercial production by extruding such unsupported thin layers. This difficulty can be overcome by using a coextrusion coating method in which two or more coating layers are extruded through a single extrusion die and, thus, simultaneously coated onto the substrate. In practical operation, we expect that all layers (two or more) in the multi-layered coating will be coextruded in a single coating operation. Accordingly, the invention includes a method of making resin coated photographic base paper which comprises co-extruding onto the face side of a paper substrate a composite coating of from 10 to 50 g.m$^{-2}$ of a first layer of a low density polyethylene or a blend of low density and high density polyethylenes containing at least 50% by weight low density polyethylene, the first layer containing at least 5% by weight of opacifying pigment, and, disposed on the side of the first layer remote from the paper substrate from 0.1 to 18 g.m$^{-2}$ of a second layer of a polymer having a stiffness modulus of at least 0.5 GPa.

As will be clear from the description above, the second layer is particularly preferably of a polycarbonate resin. The co-extruded structure can specifically include further layers such as a layer between the 'first' and 'second' coating layers of a polymer which is strongly adherent to the first and second layers. The invention further includes a method of making resin coated photographic base paper which comprises co-extruding onto the face side of a paper substrate a composite coating of first and second layers as set out above and, before or after co-extruding the coating on the face side of the paper, extrusion coating a coating of from 10 to 50 g.m$^{-2}$ of a polyolefin resin onto the wire side of the paper substrate. The coating on the wire side of the substrate can be a multilayer coating, as is described above and when this is so it can be co-extruded in a manner similar to that described above for the face side resin.

The relative amounts of layers in the face side coating can be controlled by regulating the output of the corresponding extruders. Conventional co-extrusion equipment can be used provided that it can effect extrusion at the temperatures used in making resin coated photobase which are typically 280° to 320° C. which is rather higher than in other applications. The wire side resin coating can be extrusion or co-extrusion coated before or after the co-extrusion coating of the face side and can be carried out in line on a tandem coater or off line in a separate coating step.

Generally the adhesion between gelatin based photographic emulsion and the types of polymeric resin used in photobase is not particularly good and the surface of the face side resin is treated e.g. by treatment with a corona discharge, to enhance adhesion of the emulsion. This technique can be applied to resin coated photobase of and made by the method of the present invention. Further, the enhanced adhesion between photobase and emulsion generated by corona treatment will decay over time but it is possible to apply an anti-adhesion decay agent to prevent this, typically, a solution of gelatin which generates a very thin layer of gelatin of typically less than 1 $g.m^{-2}$ which adheres firmly to the photobase and provides a good bond with the photographic emulsion. The invention includes further treating corona treated photobase with an anti-adhesion decay agent, especially a solution of gelatin to form a very thin layer of gelatin thereon.

The invention includes photographic printing paper which comprises photobase of or made by the method of the present invention carrying on top of the second layer a layer of a photographic emulsion. When present the layer of anti-adhesion decay agent will lie between the second layer and the layer of photographic emulsion.

The following Examples illustrate the invention. All parts or percentages are by weight unless otherwise stated.

The test methods used were as follows:

Stiffness (rigidity), two types of equipment were used: the Kenley tester and the Lorentzen and Wettre tester.

The test methods are as follows:

Kenley rigidity.

A strip of paper 1.5 inches (38.1 mm.) wide is clamped so that 2.25 inches (57.2 mm) of the strip protrudes vertically upwards from a horizontal lamp. A probe carrying a force sensor is positioned to move in a line 4 cm above the clamping plane, perpendicular to the mid-line along the test strip. The probe is moved to deflect the test strip to a position such that the angle between the line connecting the probe tip and the clamp is 15° from the vertical, within a period from 2.5 to 30 seconds. The stiffness is the measured force at this position. The Kenley test instrument gives the result in grams force but are expressed herein as milliNewtons (mN). (The value obtained properly has the dimensions force$\times$length$^{-1}$ but as the effective length is defined by the width of the test piece, Kenley rigidity is always quoted as the measured force).

Lorentzen and Wettre stiffness

This test is carried out on a rectangular sample of paper 70 mm by 38.1 mm. The sample is clamped in vertically disposed jaws with the long edges of the paper horizontal and the short edges vertical. The clamping jaws are mounted to be rotatable about a vertical axis. The paper is positioned to contact a vertically disposed knife edge, attached to a force sensor, and positioned 25 mm from the clamping locus in the plane of the paper surface. The clamping jaws are rotated, under machine control, through a preset angle (15°). The rigidity of the sample is the maximum force detected by the sensor. The instrument gives a digital reading in milliNewtons(mN). (As with the Kenley test instrument the result properly has dimensions of force$\times$length$^{-1}$ but is always quoted as force as indicated by the readout.)

EXAMPLE 1

178 $g.m^{-2}$ white photographic raw paper base was extrusion coated on its face side with 40 $g.m^{-2}$ of various polymer coatings. For control purposes one coating was of pigmented LDPE only, the remainder were of this invention comprising a first layer of pigmented LDPE containing 12.5% rutile titanium dioxide and a second layer of a stiff unpigmented polymer. The coating was carried out using a 2-layer pilot co-extrusion coater at a line speed of 50 $m.min^{-1}$ using a gloss chill roll. Relative and total coatweights were controlled by adjusting the output of the two extruders. The various materials used were as follows:

LDPE) from Dow Chemicals, Europe
HDPE)
PP Tenite 4G7DP from Eastman Chemicals
PC Lexan 1972-2 from General Electric Plastics
$TiO_2$ Ampacet AW11485-S (masterbatch containing 50% $TiO_2$ in LDPE)

The amounts of materials coated and the stiffness testing results are given in Table 1 below.

TABLE 1

| Sample No. | First Layer $g.m^{-2}$ | Second Layer Polymer | Second Layer $g.m^{-2}$ | Kenley Stiffness |
|---|---|---|---|---|
| Control | 40 | — | — | 18.8 |
| 1 | 36.6 | HDPE | 3.4 | 20.6 |
| 2 | 36.8 | PP | 3.2 | 20.2 |
| 3 | 39.9 | PC | 0.1 | 20.2 |

These results indicate that a substantial gain in stiffness can be achieved by including only a thin second layer of stiff polymer in the face side resin coating. The effect is particularly noticeable for polycarbonate where only a very thin second layer was produced.

EXAMPLE 2

Raw photographic base paper having a grammage of 170 $g.m^{-2}$ was resin coated on a pilot 2-layer co-extrusion coating line using a matt chill roll. Various coating structures were produced as set out in Table 2a below. The control structure was made by co-extruding pigmented LDPE in both extrusion channels of the co-extruder onto the new base paper to give effectively a monolayer. The three layer structures were made by first extruding a monolayer coating the raw base with the specified coatweight of pigmented LDPE and subsequently co-extrusion coating on top the specified EVA/PC layer. The photobase was subsequently mono-extrusion coated on the wire side with an unpigmented coating of 27 $g.m^{-2}$ of a 1:1 blend of LDPE and HDPE. The results of stiffness testing (Lorenzen and Wettre) are set out in Table 2b below. The polymers used in the face side resin coatings were as follows:

LDPE Escorene LD252 from Esso Chemicals Ltd.
$TiO_2$ Ampacet AW11485-S
EVA Escorene UL00909, an EVA copolymer containing 9% VA units by wt.
PC Lexan 1972-2

The pigmented EVA used was a blend of Escorene EVA (71.19) and Ampacet masterbarch (28.9%).

EXAMPLE 3

Raw photographic base paper having a grammage of 165 $g.m^{-2}$ was resin coated by co-extrusion using a gloss chill roll. Various coating structures were produced as described below with the coatweights (as measured on the product) given in Table 3a below.

The materials used were as follows:

LDPE Escorene LD 252
$TiO_2$ Ampacet AW 11485-S
HDPE from Dutch State Mines
EVA Escorene UL 00909
PC Lexan 1972-2

Pigmented resin layers were made up using appropriate amounts of unpigmented resin and of $TiO_2$ masterbatch.

The products made according to the invention had a face side coating comprising an inner layer of a pigmented blen of LDPE and HDPE (57.8% LDPE+13.3% HDPE+28.9% $TiO_2$ masterbatch in LDPE) an intermediate layer of pigmented EVA (71.1% EVA+28.9% $TiO_2$ master batch in LDPE) and and outer layer of PC, and a wire side coating comprising an inner layer of a blend of 50% LDPE and 50% HDPE, an intermediate layer of unpigmented EVA and an outer layer of PC. The inner and intermediate layers on both sides of the photobase are difficult to distinguish from each other in the product. In Table 3a below the intended or "target" coatweights for the individual inner intermediate ("inter") and outer layers are given with the measured coatweight (derived from thickness measurement) of the inner and inter layers combined and of the outer layer, which can be distinguished by microscopic examination.

The results of stiffness and gloss testing are given in Table 3b below. Because both face and wire side coatings include a layer of polycarbonate the marked anisotropy of stiffness noted in Example 2 was not observed. The gloss measurements are comparative rather than absolute measurements because although the chill roll used was a gloss chill roll, its surface finish was somewhat variable, and this variation could be visually observed during coating, and the surface quality of the chill roll was inferior to the standard of gloss chill roll finish on production extrusion coaters for photobase. Despite this the product made by co-extrusion to give a polycarbonate layer on the exterior on the face side had superior gloss to the control. The products obtained were assessed for the occurrence of pits. The number and size of pits in the resin coating were both significantly smaller in the product made according to the invention as compared with the control. All the products of the invention showed no evidence of gels.

Two control samples were used in this Example. For comparing stiffness the control was of a standard commercial resin coated photobase for colour printing based on a 165 $g.m^{-2}$ raw base with a mono-extruded face side resin coating of 30 $g.m^{-2}$ of a pigmented blend of LDPE and HDPE) and a mono-extruded wire side resin coating of 30 $g.m^{-2}$ of an unpigmented blend of 50% LDPE and 50% HDPE. For comparing gloss and pitting the face side of 165 $g.m^{-2}$ raw photobase was mono-layer coated in the co-extrusion line with a 30 $g.m^{-2}$ coating of a pigmented blend of LDPE and HDPE (57.8% LDPE+13.3% HDPE+28.9% $TiO_2$ masterbatch in LDPE). Gloss measurements were made using a Mk2 Glossmeter with a 75° Glosshead (made by Sheen Instruments Ltd.). The meter produces a reading from 0% i.e. a matt black surface (the instrument is zeroed using the matt standard provided) and 100%. The scaling is set using a gloss standard (in this case a black glass plate with a stated gloss of 97.8 using the 75° Glosshead).

TABLE 2a

| Sample | Face side resin coating | | | | | | | | |
|---|---|---|---|---|---|---|---|---|---|
| | First layer | | | intermediate layer | | | second layer | | |
| No. | Resin | Amount | % $TiO_2$ | Resin | Amount | % $TiO_2$ | Polymer | Amount | % $TiO_2$ |
| Control | LDPE | 13.5 | 12.5 | N/A | N/A | N/A | LDPE | 13.5 | 12.5 |
| 1 | LDPE | 13.5 | 16.7 | EVA | 6.75 | 16.7 | PC | 6.1 | 0 |
| 2 | LDPE | 10 | 22.5 | EVA | 8 | 22.5 | PC | 10.4 | 0 |
| 3 | LDPE | 10 | 22.5 | EVA | 5 | 22.5 | PC | 12.1 | 0 |

TABLE 2b

| Sample | Stiffness | | | | | | | |
|---|---|---|---|---|---|---|---|---|
| | Machine Direction | | | | Cross Direction | | | |
| No. | + | − | mean | diff | + | − | mean | diff |
| Control | 134.5 | 136.8 | 135.8 | 0 | 76.4 | 68.9 | 75.2 | 0 |
| 1 | 145.0 | 143.7 | 144.3 | +6.3 | 92.0 | 78.4 | 85.2 | +13.3 |
| 2 | 152.9 | 155.2 | 154.0 | +13.4 | 109.5 | 77.5 | 93.3 | +24.1 |
| 3 | 151.6 | 153.8 | 152.7 | +12.4 | 109.4 | 78.4 | 93.9 | +24.9 |

Key to Table
+ = face side resin in tension
− = face side resin in compression
diff = percentage difference between sample mean and control mean TABLE 3a

| Sample No. | | Face side | | | Wire Side | | |
|---|---|---|---|---|---|---|---|
| | | inner | inter | outer | inner | inter | outer |
| 1 | target | 18 | 8 | 4 | 18 | 8 | 4 |
| | actual | 27.7 | | 6.2 | 18.6 | | 5.6 |
| 2 | target | 18 | 6 | 6 | 18 | 6 | 6 |
| | actual | 31.6 | | 6.7 | 15.4 | | 7.1 |
| 3 | target | 18 | 4 | 8 | 18 | 4 | 8 |
| | actual | 24.4 | | 8.5 | 20.1 | | 7.8 |

TABLE 3b

| Sample | Stiffness | | | | | | | | Gloss Rating | | |
|---|---|---|---|---|---|---|---|---|---|---|---|
| | Machine Direction | | | | Cross Direction | | | | | | |
| No. | + | − | mean | diff | + | − | mean | diff | F.S. | W.S. | diff. |
| Control | — | — | 139.5 | 0 | — | — | 78.6 | 0 | 87.4 | 82.6 | 0 |
| 1 | 150.5 | 145.2 | 147.9 | +6.0 | 83.5 | 99.0 | 92.3 | +17.4 | 96.1 | 90.5 | +9.7 |
| 2 | 165.0 | 156.4 | 160.7 | +15.7 | 95.4 | 104.1 | 29.8 | +27.0 | 94.3 | 97.5 | +12.8 |
| 3 | 170.7 | 162.1 | 166.4 | +19.3 | 97.8 | 112.9 | 105.4 | +34.0 | 90.2 | 95.8 | +9.4 |

Key to Table
+ = face side resin in tension
− = face side resin in compression
diff = percentage difference between sample mean and control mean
F.S. = face side
W.S. = wire side

I claim:

1. Resin coated photographic base paper comprising a substrate of paper and a composite coating comprising (1) from 10 to 50 $g.m^{-2}$ of an extruded first coating layer consisting essentially of a low density polyethylene (having a density of 0.910–0.940 $g/cm^3$) or a blend of low density and high density polyethylenes (the high density polyethylenes having a density greater than or equal to 0.941 $g/cm^3$) containing at least 50% by weight of low density polyethylene, the first coating layer containing at least 5% by weight of opacifying pigment and, (2) overlying the first coating layer and firmly bonded thereto, from 0.1 to 18 $gm^{-2}$ of an extruded second coating layer of a polymer having a stiffness modulus of at least 2.0 GPa.

2. Photographic base paper as claimed in claim 1 wherein the second layer is of polycarbonate.

3. Photographic base paper as claimed in claim 1 wherein the second layer has a coatweight of from 1 to 15 $g.m^{-2}$.

4. Photographic base paper as claimed in claim 3 wherein the second layer has a coatweight of from 3 to 10 $g.m^{-2}$.

5. Photographic base paper as claimed in claim 1 which includes a layer, intermediate the base paper and the said first coating layer, a layer of from 1 to 10 $g.m.^{-2}$ of a polymer, which is strongly adhesive towards both the base paper and the first coating layer, serving to firmly bond the said base paper and first coating layer.

6. Photographic base paper as claimed in claim 1 wherein the wire side of the base paper is coated with from 10 to 50 $g.m.^{-2}$ of a polyolefin resin coating.

7. Photographic base paper as claimed in claim 6 wherein the polyolefin resin of the first wire side layer is LDPE or a blend of LDPE and HDPE.

8. Photographic base paper as claimed in claim 6 wherein the wire side coating comprises from 10 to 50 $g.m.^{-2}$ of a first wire side coating layer of an extruded polyolefin resin and overlying the first wire side coating layer and firmly bonded thereto, from 0.1 to 18 $g.m.^{-2}$ of an extruded second coating layer of a polymer having a stiffness modulus of at least 0.5 GPa.

9. Photographic base paper as claimed in claim 8 wherein the second wire side coating layer is from 3 to 10 $g.m.^{-2}$ of polycarbonate.

10. Photographic base paper as claimed in claim 6 in which the wire side resin coating includes a layer, intermediate the base paper and the said first coating layer, a layer of from 1 to 10 $g.m.^{-2}$ of a polymer, which is strongly adhesive towards both the base paper and the first coating layer, serving to firmly bond the said base paper and the first coating layer.

11. Resin coated photographic base paper comprising a substrate of paper carrying on its face side a composite coating comprising:

from 10 to 50 $gm^{-2}$ of an extruded first coating layer consisting essentially of a low density polyethylene (having a density of 0.910–0.940 $g/cm^3$) or a blend of low density and high density polyethylene (having a density greater than or equal to 0.941 $g/cm^3$) containing at least 50% by weight of low density polyethylene, the first coating layer containing at least 5% by weight of opacifying pigment;

from 0.1 to 18 $gm^{-2}$ of an extruded second coating layer of a polymer having a stiffness modulus of at least 2.0 GPa; and intermediate the said first and second coating layers, a layer of from 1 to 10 $gm^{-2}$ of a polymer, which is strongly adhesive towards both the first and second layers, serving to firmly bond the said first and second layers.

12. Photographic base paper as claimed in claim 10 wherein the intermediate layer is of ethylene-vinyl acetate copolymers (EVA), ethylene-acrylic acid copolymers (EAA), ethylene-methacrylic acid copolymers (EMA) and the ethylene-vinylacetate terpolymers, ethylene terpolymers and chemically modified polyolefin resins.

13. Photographic base paper as claimed in claim 11 wherein the second layer is of a polycarbonate.

14. Photographic base paper as claimed in claim 11 wherein the second layer has a coatweight of from 1 to 15 $gm^{-2}$.

15. Photographic base paper as claimed in claim 14 wherein the second layer has a coatweight of from 3 to 10 $gm^{-2}$.

16. Resin coated photographic base paper, comprising a substrate of paper to which has been applied, by extrusion, a combination of coating layers, which combination essentially consists of:

(i) a first resin coating layer of which at least 5 wt % is pigment, the resin of the said first layer consisting essentially of low density polyethylene (having a density of 0.910–0.940 $g/cm^3$) or a blend of low density and high density polyethylene (the high density polyethylene having a density greater than or equal to 0.941 $g/cm^3$ containing at least 50 wt % low density polyethylene and said first layer being coated at a coatweight in a range of from 10 to 50 $gm^{-2}$; and (ii) a second resin coating layer, present on a side of the first coating layer remote from said substrate, of a resin having a stiffness modulus (in accordance with ASTM D790-80) of at least 2.0 GPa, and said second layer being coated at a coat weight in a range of from 0.1 to 18 $gm^{-2}$.

17. Photographic base paper as claimed in claim 16 wherein said second layer is coated at a coatweight in a range of from 3 to 10 $gm^{-2}$.

* * * * *